United States Patent [19]

Takaishi et al.

[11] Patent Number: 4,534,199

[45] Date of Patent: Aug. 13, 1985

[54] METHOD AND APPARATUS FOR PRODUCED STEPPED TUBES

[75] Inventors: Kazuhide Takaishi; Toshiki Kadonaga; Masamitsu Tamura; Shigeharu Nakamura; Mitsuru Mizoguchi, all of Shimonoseki; Yoshinobu Hirota, Yamaguchi; Yukinobu Yamazaki, Shimonoseki, all of Japan

[73] Assignee: Kabushiki Kaisha Kobe Seiko Sho, Kobe, Japan

[21] Appl. No.: 532,070

[22] Filed: Sep. 14, 1983

[30] Foreign Application Priority Data

Sep. 16, 1982 [JP] Japan ..... 57-163021

[51] Int. Cl.[3] ..... B21C 37/20; B21C 37/15; B21C 1/24

[52] U.S. Cl. ..... 72/276; 72/283; 72/370

[58] Field of Search ..... 72/276, 283, 357, 370

[56] References Cited

U.S. PATENT DOCUMENTS

| | | | |
|---|---|---|---|
| 2,228,301 | 1/1941 | Ditzel et al. | 72/276 |
| 2,258,242 | 10/1941 | Ditzel et al. | 72/276 |
| 4,313,328 | 2/1982 | Janssen et al. | 72/370 |

FOREIGN PATENT DOCUMENTS

| | | | |
|---|---|---|---|
| 2758136 | 4/1979 | Fed. Rep. of Germany | 72/283 |
| 3021481 | 12/1981 | Fed. Rep. of Germany | 72/283 |
| 31426 | 2/1982 | Japan | 72/283 |
| 564030 | 7/1977 | U.S.S.R. | 72/283 |

*Primary Examiner*—Lowell A. Larson

*Attorney, Agent, or Firm*—Oblon, Fisher, Spivak, McClelland & Maier

[57] ABSTRACT

A method of producing a stepped tube, the method including the steps of preparing a straight mother tube with a stepped wall portion of a smaller inside diameter on the inner periphery thereof at a predetermined position in the longitudinal direction of the tube between opposite straight portions of a larger inside diameter; inserting the mother tube in a clearance a split die having a die cavity between bearing portions provided at opposite ends thereof and separable into first and second halves in the longitudinal direction at a median point of the die cavity and a plug member extensible through the die cavity; gripping a mouth portion of the mother tube by a carriage while positioning the plug member at one of the die bearing portions on the side of the carriage; moving the carriage in the longitudinal direction of the tube until the stepped wall portion on the inner periphery of the mother tube aligns with the die cavity, thereby expanding and stretching one of the straight portions; next moving the plug member up to the other die bearing portion to expand the inner stepped wall portion into and along the die cavity, forming a reversed stepped wall portion on the outer periphery of the mother tube; releasing the joined first and second halves of the split die to permit the first die half on the side of the carriage to move in the longitudinal direction of the tube; and moving the carriage again in the longitudinal direction of the tube to expand and stretch the other straight portion, thereby forming a tube with a circumferential stepped wall portion from a mother tube with an inner stepped wall portion.

6 Claims, 13 Drawing Figures

METHOD AND APPARATUS FOR PRODUCED STEPPED TUBES

BACKGROUND OF THE INVENTION

1. Field of the Invention

This invention relates to a method and an apparatus for producing a stepped tube which is formed with a stepped wall portion of a larger diameter integrally around its circumference at a desired position in the longitudinal direction of the tube.

2. Description of the Prior Art

Stepped tubes are used mainly in the nuclear industry, but it has been extremely difficult to manufacture the tubes in compliance with the very strict standards of accuracy which are generally required in that industry.

More specifically, it has been found very difficult to form a stepped wall portion of required dimensions at a predetermined position in a tube without causing torsional or bending deformations thereto. Straightening of the tube subsequent to a forming operation is inevitable, especially in a case of a polygonal stepped tube, for example, a tube of a hexagonal shape in section. Therefore, the accuracy of the forming operation governs the accuracy of the ultimate product, so that the shape and dimensions after a forming operation should be within the ranges of prescribed standards.

Besides the accuracy in shape, the tube is required to comply with the accuracy required regarding the uniformity of physical properties, for example, to have uniform distribution of hardness in the straight and stepped portions of the tube. In order to ensure unformity of hardness, it is necessary to work the straight and stepped portions of the tube at the same working rate, which, however, involves extraordinary technical difficulties.

SUMMARY OF THE INVENTION

With the foregoing in view, the present invention has as its object the provision of a method which is capable of producing stepped tubes with high accuracy in shape and physical properties in a simplified manner.

It is another object of the present invention to provide a method of producing stepped tubes with high accuracy regarding shape and physical properties at a reduced production cost.

It is still another object of the present invention to provide an apparatus for carrying out the above-mentioned method.

According to one aspect of the present invention, there is provided a method of producing a stepped tube, the method comprising: preparing a straight mother tube with a stepped wall portion of a smaller inside diameter on the inner periphery thereof at a predetermined position in the longitudinal direction of the tube between opposite straight portions of a larger inside diameter; inserting the mother tube in a clearance a split die having a die cavity between bearing portions provided at opposite ends thereof and separable into two halves in the longitudinal direction at a median point of the die cavity and a plug member extensible through the die cavity; gripping a mouth portion of the mother tube by a carriage while positioning the plug member at one of the die bearing portions on the side of the carriage; moving the carriage in the longitudinal direction of the tube until the stepped wall portion on the inner periphery of the mother tube aligns with the die cavity, thereby expanding and stretching one of the straight portions; next moving the plug member up to the other die bearing portion to expand the inner stepped wall portion into and along the die cavity, forming a reversed stepped wall portion on the outer periphery of the mother tube; releasing joined halves of the split die to permit the die half on the side of the carriage to move in the longitudinal direction of the tube; and moving the carriage again in the longitudinal direction of the tube to expand and stretch the other straight portion, thereby forming a tube with a circumferential or outer stepped wall portion from a mother tube with an inner stepped wall portion.

According to the present invention, there is also provided an apparatus for carrying out the above-mentioned method, said apparatus comprising in combination: a carriage movable in the longitudinal direction of a mother tube with a stepped wall portion of a smaller inside diameter on the inner periphery thereof at a predetermined position in the longitudinal direction and between opposite straight portions of a larger inside diameter, while concentrically gripping a mouth portion at one end of the mother tube; a split die located concentrically with the carriage and having a cavity between bearing portions provided at the opposite ends thereof, the split die being separable into first and second halves in the longitudinal direction of the mother tube at a median point of the die cavity, the first die half being movable in the longitudinal direction toward and away from the second die half; a plug member adapted to be inserted into the mother tube and movable in the longitudinal direction thereof, forming a clearance of a predetermined width around the inner periphery of the die bearing portions; a carriage drive mechanism adapted to move the carriage until the inner stepped wall portion of the gripped mother tube aligns with the die cavity and to rest the carriage at that position for a predetermined time length before advancing the carriage further in the same direction; a plug drive mechanism adapted to position and hold the plug fixedly in the bearing portion on the side of the carriage during the first movement of the carriage, to advance the plug member up to the other bearing portion during the rest time of the carriage, and to hold the plug member fixedly at that position during advancing of the carriage; and releasable fixing means adapted to hold the first and second die halves in joined state during the first movement of the carriage as well as during movement of the plug member and to release the first and second die halves from the joined state prior to advancing of the carriage.

The above and other objects, features and advantages of the present invention will become apparent from the following description and the appended claims, taken in conjunction with the accompanying drawings which show by way of example some illustrative embodiments of the invention.

BRIEF DESCRIPTION OF THE DRAWINGS

In the accompanying drawings:

FIG. 1(*b*) is a schematic cross-sectional view of the mother tube of FIG. 1(*a*);

FIG. 2(*b*) is a schematic cross-sectional view of the mother tube of FIG. 2(*a*);

DETAILED DESCRIPTION OF THE PREFERRED EMBODIMENTS

Figure 1A:
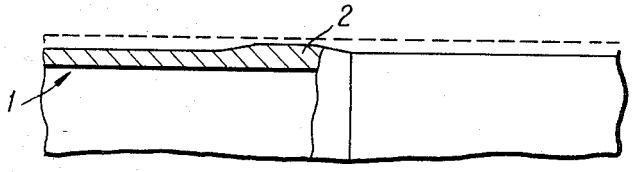
FIG. 1(*a*) is a fragmentary schematic longitudinal sectional view of a mother tube with a stepped wall portion on the outer periphery thereof.

The invention is hereafter illustrated more particularly by way of the preferred embodiments shown in the drawings, which concern the production of stepped tubes of hexagonal shape in section with a stepped wall of an increased thickness on the circumference at a predetermined position along the length of the tubes.

Figure 1B:
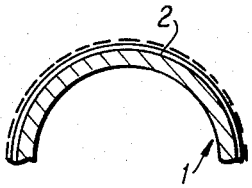

As shown in FIGS. 1(*a*) and 1(*b*), the circumferential wall of a straight, sectionally round mother tube 1 is firstly profiled into a thickness including an allowance as determined by the desired working rate (mainly in thickness), forming a stepped wall portion 2 of a larger diameter on the circumference of the mother tube 1 at a predetermined position in the longitudinal direction of the tube. Instead of profile milling, the circumferential stepped wall portion 2 may be formed by drawing or other operations.

Figure 2B:
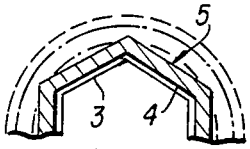
FIG. 2(*a*) is a fragmentary schematic longitudinal sectional view of a mother tube with a stopped wall portion on the inner periphery thereof.
Figure 2A:
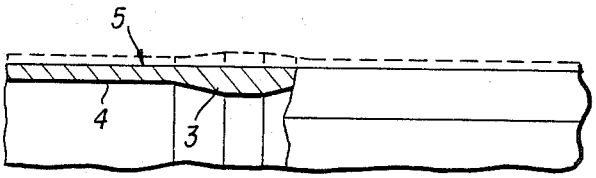

In the next step, the mother tube 1 with the circumferential stepped wall is formed into a hexagonal shape in section by a sinking operation using a hexagonal die, thereby reversing the circumferential stepped wall 2 to form an inner stepped wall 3 on the inner periphery of the mother tube 1 as shown in FIGS. 2(*a*) and 2(*b*). Consequently, there is obtained a hexagonal stepped mother tube 5 which is straight on the outer periphery and provided with the inner stepped portion 3 of a smaller diameter on its inner periphery at an intermediate position in the longitudinal direction between straight portions 4.

Figure 4:
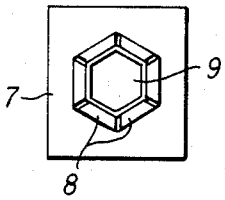
FIG. 4 is a schematic sectional view taken on line IV—IV of FIG. 3.
Figure 3:
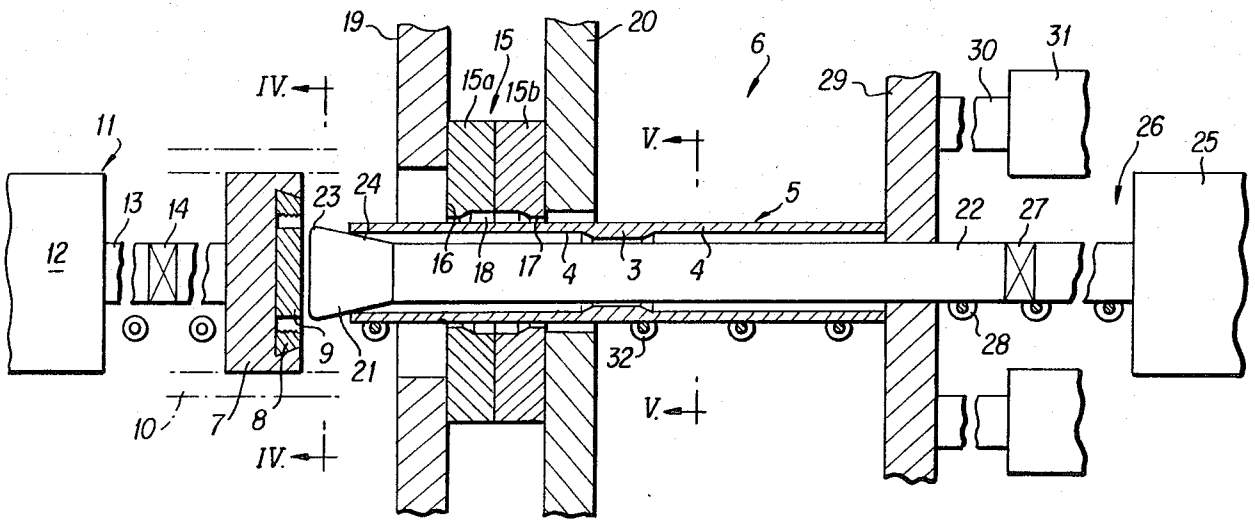
FIG. 3 is a schematic sectional view of an apparatus for producing hexagonal stepped tubes.
Figure 6A:
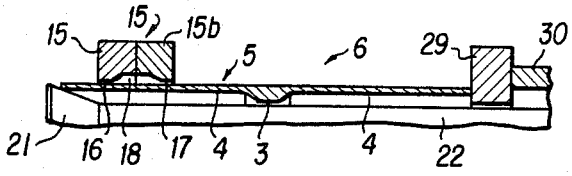
FIGS. 6(*a*) to 6(*f*) are fragmentary longitudinal sectional view showing the steps for producing a hexagonal stepped tube.
Figure 6B:
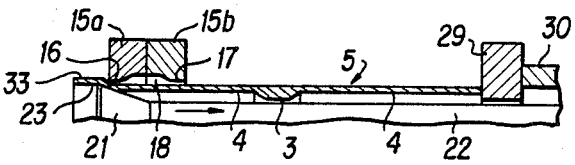
Figure 6C:
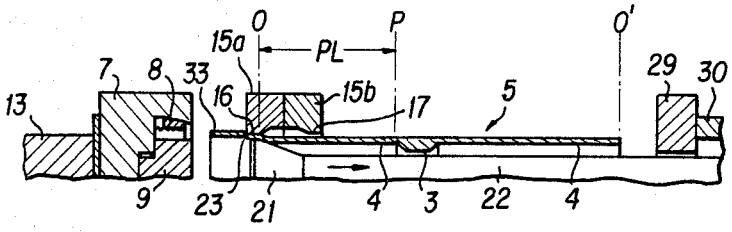
Figure 6D:
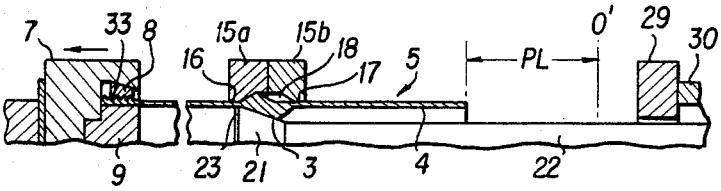
Figure 6E:
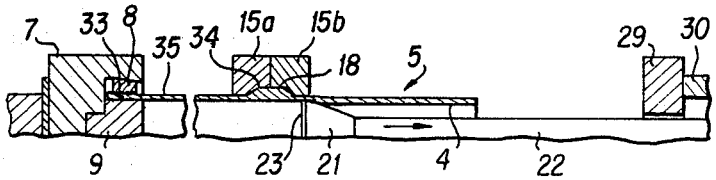
Figure 6F:
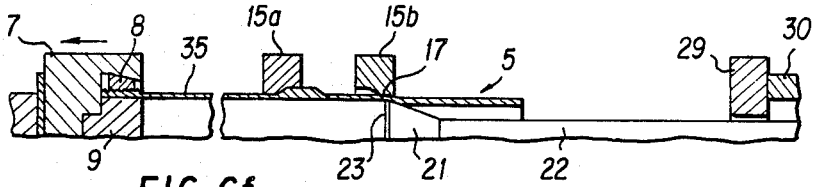

FIG. 3 illustrates a forming machine 6 for producing a hexagonal stepped tube from the mother tube 5 with the reversed stepped wall 3 by reversing again the stepped wall 3 to project on the outer periphery of the tube. In this figure, indicated at 7 is a carriage which transfers the mother tube 5 in the longitudinal direction by gripping one open end of the tube 5. Built into the front side of the carriage 7 are chuck claws 8 and a core rod 9 which cooperate to grip the mouth portion of the mother tube 5. As shown particularly in FIG. 4, the chuck claws 8 consist of six claw sections which are disposed to circumvent the respective sides of a hexagonal core rod 9. The chuck is adapted to receive the mouth portion of the mother tube 5 in the gaps or spaces between the claws 8 and the circumferential surface of the core rod 9 and to grip the tube securely therein by contracting the six claw sections toward the core rod 9. Thus, the chuck claws 8 can be contracted or opened as desired.

The carriage 7 is movable in the longitudinal direction of the tube along guide rails 10, and, for this purpose, a carriage drive mechanism 11 is provided on the back side of the carriage 7. In the particular embodiment shown, the carriage drive mechanism 11 is constituted by a hydraulic piston-cylinder 12 which has a piston rod 13 securely fixed to the rear side of the carriage 7. A load cell 14 is provided in an intermediate portion of the cylinder rod 13 to check whether the withdrawing force is normal or not.

Designated at 15 is a split die which is located concentrically with the carriage 7 and opposite the claws 8 on the front side of the carriage 7. Provided concentrically at opposite ends of the die 15 are hexagonal bearing portions 16 and 17 which are identical in shape and size. The die 15 is provided with a hexagonal cavity 18 between the bearing portions 16 and 17. The split die 15 is separable into halves at a median point of the cavity 18. More particularly, the die 15 is separable into a first die 15*a* located on the side of the carriage 7 and a second die 15*b* located on the side remote from the carriage 7, which are movable toward and away from each other in the longitudinal direction of the tube.

The first and second dies 15*a* and 15*b* are gripped between and clamped to each other by stands 19 and 20 which are located on the opposite sides of the die 15. The second die 15*b* is securely fixed to one stationary stand 20 by a suitable clamping means. On the other hand, the first die 15*a* is separably engageable with the other stand 19 and movable toward and away from the latter when released. Thus, the first and second dies 15*a* and 15*b* of the split die 15 are separably joined with each other by the above-mentioned releasable fixing means. It is to be understood that the first and second dies 15*a* and 15*b* may be engaged through a taper joint instead of the flush joint employed in the particular embodiment shown in FIG. 3.

Indicated at 21 is a plug which is located concentrically on the front side of the carriage 7 and formed of a hexagonal shape in section. The plug 21 is detachably fixed at the fore end of a plug rod 22 which is passed through the die cavity of the split die 15, and constituted by a plug bearing portion 23 of a larger diameter and a taper portion 23 the diameter of which is reduced toward the plug rod 22. The mother tube 5 is stretched and drawn as it is passed through a hexagonal annular clearance formed between the plug bearing portion 23 and the die bearing portion 16 or 17.

The plug rod 22 functions as a cylinder rod of a hydraulic cylinder 25 which is provided at the rear end of the rod 22, so that the plug 21 is fixably movable in the longitudinal direction of the tube by the operation of the hydraulic cylinder 25 which constitutes a plug drive mechanism 26. A load cell 27 is inserted within the length of the plug rod 22 to detect the plug withdrawing force. The plug rod 22 is retained in a horizontal position by means of a number of guide rolls 28 which are provided at suitable intervals along the length of the ®plug rod 22.

Reference numeral 29 denotes a stopper which is fitted on the plug rod 22 and separably abutted against the tail end of the mother tube 5 in the split die 15 to restrict the longitudinal movement of the tube 5. The stopper 29 is connected to screw rods 30 and a screw drive mechanism 31 for movement in the longitudinal direction toward and away from the tail end of the mother tube 5. The screw drive mechanism 31 may be constituted by a hydraulic cylinder or other suitable means.

Figure 5:
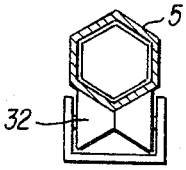
FIG. 5 is a schematic sectional view taken on line V—V of FIG. 3.

As shown particularly in FIG. 5, the mother tube 5 is supported by pipe guide rolls 32 with grooves of V-shape in section for longitudinally movably supporting the circumference of the mother tube 5. The guide rolls 32 also serve as the above-mentioned guide rolls 28 which support the plug rod 22. Although not shown in the drawing, the pipe forming machine 6 is provided with a stepped portion, alignment control means which controls the start and stop timing of the operation by detecting the distances of movement of the mother tube 5 and plug 21.

Now, the method of producing a hexagonal stepped tube by the above-described pipe forming machine is explained with reference to FIGS. 6(*a*) to 6(*f*). FIG. 6(*a*) shows a state in which a hexagonal mother tube 5 with a reversed stepped wall portion is set in position on the machine and the split die 15 is pressingly fixed between the stands 19 and 20. In this state, the plug rod 22 is inserted through the split die 15 such that the mother tube 5 is fitted on the plug rod 22 in the split die 15. Mother tube 5 is inserted and set in such a position that its fore end is projected out of the first die 15*a* by a length which is suitable to be gripped by the claws 8 of the carriage 7. The stopper 20 is then advanced toward the tail end of the mother tube 5 which has thus been set in position, and fixed in slight abutting engagement with the tail end of the mother tube 5. Thereafter, the plug 21 is fixed at the fore end of the plug rod 22. Now, the machine is put in the set position shown in FIG. 6(*a*).

FIG. 6(*b*) shows the first step of operation in which the fore end of the mother tube 5 is spread to form a mouth portion 33. More specifically, the hydraulic cylinder 25 of the plug drive mechanism 26 is contracted to retract the plug 21, forming a mouth portion 33 by spreading the projected end of the mother tube 5 and stopping the plug 21 on the front side of the bearing portion 16 of the first die 15*a*. Then, the stopper 29 is retracted to release the tail end of the mother tube 5 from its restricting action.

In the second step of operation shown in FIG. 6(*c*), the plug 21 is further retracted and stopped as soon as it enters the bearing portion 16 of the first die 15*a*, locking the hydraulic cylinder 25 of the plug drive mechanism 26 at that position. In this state, the position (O) of the bearing portion 16 of the first die 15*a*, which coincides with the position of the bearing portion 23 of the plug 21, is stored in the aforementioned stepped portion alignment control device, along with the distance (PL) from a reference point P of the stepped wall portion 3 of the mother tube 5 and the tail end position (O') of the mother tube 5. These stored data are indicated on a digital display.

In the third step, the carriage 7 is moved toward the mother tube 5 as shown in FIG. 6(*d*), stopping the carriage 7 as soon as the mouth portion 33 of the mother tube 5 is inserted between the hexagonal chuck claws 8 and the core block 9. Then, while gripping the mouth portion 33 by the claws 8, the hydraulic cylinder 12 of the carriage drive mechanism 11 is contracted to move the carriage in a direction away from the mother tube 5. This movement is continued until the tail end of the mother tube 5 is displaced by the aforementioned distance (PL), whereupon the carriage 7 is stopped and the hydraulic cylinder 12 of the carriage drive mechanism 11 is locked. The distance of displacement of the tail end of the mother tube 5 is detected by a magnescale or other suitable means to control its stopping position by the stepped portion alignment control device. Of course, the distance of displacement can be detected by way of the distance of movement of the carriage 7. In such a case, however, there arises the necessity of taking into consideration the elongation of the mother tube 5 although it is practically disadvantageous. Namely, the displacement of the tail end of the mother tube 5 by the distance (PL) means that the reference point P of the stepped wall portion 3 of the mother tube 5 has reached the plug bearing position (O) and that the stepped wall portion 3 has been aligned exactly with the cavity 18 of the split die 15. As a result of this displacement of the carriage 7, one of the straight portions 4 on opposite sides of the stepped wall portion 3 is stretched and drawn through the clearance between the bearing portion 16 of the first die and the plug bearing portion 23.

Next, in the forth step shown in FIG. 6(*e*), the hydraulic cylinder 25 of the plug drive mechanism 26 is released from the locked state, and the plug 21 is moved up to the bearing portion 17 of the second die 15*b* by contraction of the cylinder 25. Whereupon, the cylinder 25 is locked again. In a similar manner, the distance of displacement of the plug is also controlled by the stepped portion alignment control device. As a result of this displacement, the stepped wall portion 3 of the mother tube 5 is reversed to project into the cavity 18 of the split die 15, forming a circumferential stepped wall 34 along the cavity 18.

The releasable fixing means of the split die 15 is then actuated to free the first die 15*a*, that is to say, the stand 19 which has been abutted against the first die 15*a* is released to render the first die 15*a* movable in the longitudinal direction of the tube. However, the second die 15*b* which is fixed to the other stand 20 remains stationary in the same position.

In the fifth step shown in FIG. 6(*f*), the carriage 7 is moved again to the left in the drawing to expand and stretch the other straight portion 4 through the clearance between the bearing portion 17 of the second die 15*b* and the bearing portion 23 of the plug. As the first die 15*a* is moved by this displacement of the carriage 7, it is continously kept in engagement with the circumferential stepped wall portion 34. The first die 15*a* is removed by an adjacently located subdrawer.

Thus, upon moving the carriage 7 until the tail end of the mother tube 5 is passed through the clearance between the bearing portion 17 of the second die 15*b* and the plug bearing portion 23, there is obtained a hexagonal stepped tube 35 with a circumferential stepped wall portion 34, thus completing one cycle of the forming operation.

According to the above-described embodiment of the present invention, the stepped wall portion 3 of a mother tube is positioned in alignment with the cavity 18 of the split die 15 by detection of the distance of movement of the tail end of the mother tube, so that it becomes possible to attain accurate alignment of the cavity 18 and the stepped wall portion 3 without being influenced by the longitudinal elongation of the tube being stretched and drawn, thus ensuring a constant working rate as well as improvements of the uniformity of physical properties and accuracy of shape.

Thus, the present invention employs a short split die 5, and the straight portions 4 of the mother tube 5 are enlarged and drawn by displacing the tube 5 relative to the die 15 and plug 21. On the other hand, the stepped wall portion 3 of the mother tube 5 is enlarged and drawn by the displacement of the plug 21 relative to the mother tube 2 which is held stationary to the die 15. Therefore, there is no possibility of the accuracy of aligning operation being adversely affected by the tube elongation or the like. On the contrary, in a case where a mother tube is received in a long die substantially coextensive with the tube and formed by the displacement of a plug over the entire length of the tube, difficulty is often encountered in aligning the stepped wall portion of the tube with the die cavity, coupled with the problem that the longitudinal elongation of the tube resulting from the displacement of the plug causes misalignment of the stepped wall portion and the die cavity even if they were initially in exactly aligned positions. Consequently, before the plug reaches the stepped wall portion, the latter is deviated from the aligned position, and this positional deviation of the stepped wall portion occurs in a greater degree with a longer tube.

Further, the short die 15 employed in the embodiment of the present invention has an economical advantage over the long die since it can be fabricated at a significantly reduced cost.

The provision of guide rolls 28 and 32 which support the mother tube 5 and plug rod 22 in horizontal state contributes to the improvement of accuracy of the products since a lengthy mother tube can be retained correctly in horizontal state. The guide rollers 28 and 32 are movable up and down in the vertical direction, so that they are in lifted positions for supporting the plug rod 22 and in a lowered position for supporting the mother tube 5. As the tail end of the mother tube 5 passes over the guide rollers 32, they are successively lifted to support the plug rod 32. Therefore, the plug rod 22 is prevented from hanging down due to its own weight when the plug 21 is disengaged from the mother tube 5 upon completion of drawing. On the other hand, when inserting a mother tube 5 on the plug rod 22, the guide rollers 28 which support the plug rod 22 are successively lowered in relation to the advancing movement of the tube 5 to retain the latter in horizontal state.

Of course, the present invention is not restricted to the above-described particular embodiment nor to hexagonal stepped tubes, and can similarly produce stepped tubes of other polygonal shape or of round shape in section.

Thus, according to the present invention, the stepped wall portion of the mother tube and the die cavity can be aligned with an extremely high accuracy, improving as a result the accuracy in shape and physical properties of the ultimate products. As clear from the foregoing description, the invention has a number of advantages in practical applications.

What is claimed as new and desired to be secured by Letters Patent of the United States is:

1. A method of producing a tube with a circumferential stepped wall portion from a mother tube with a stepped wall portion on the inner periphery thereof utilizing a die cavity; a split die separable into first and second halves in a longitudinal direction; a plug member extending into said die cavity and a carriage; wherein said method comprises:

preparing a straight mother tube so as to have a stepped wall portion of a smaller inside diameter on the inner periphery thereof at a predetermined position in the longitudinal direction of said tube between first and second opposite straight portions of a larger inside diameter;

inserting said mother tube in a clearance between said split die separable into said first and second halves in a longitudinal direction at a median point of said die cavity and having a first and second bearing portions at opposite ends thereof, respectively, and said plug member extending through said die cavity;

gripping a mouth portion of said mother tube by said carriage while positioning said plug member at said first die bearing portion on a side of said carriage;

moving said carraige in a longitudinal direction of said mother tube until said stepped wall portion on the inner periphery of said mother tube aligns with said die cavity, thereby expanding and stretching said first straight portion;

moving said plug member up to said second die bearing portion to expand and stretch the inner stepped wall portion into and along said die cavity, thereby forming a reversed stepped wall portion on the outer periphery of said mother tube;

releasing said first and second halves of said split die to permit the first die half located on a side of said carraige to move in a longitudinal direction of said tube; and moving said carriage again in said longitudinal direction to expand and stretch the second straight portion of said tube, thereby forming a tube with a circumferential stepped wall portion.

2. An apparatus for producing a tube with a circumferential stepped wall portion from a mother tube with a stepped wall portion on the inner periphery thereof, said apparatus comprising;

a carriage movable in the longitudinal direction of said mother tube, said mother tube having a stepped wall portion of a smaller inside diameter on the inner periphery thereof at a predetermined position in the longitudinal direction and between opposite straight portions of a larger inside diameter and which concentrically grips a mouth portion at one end of said mother tube;

a split die located concentrically with said carriage and having a cavity formed between bearing portions provided at the opposite ends thereof, said split die being separable into first and second halves in a longitudinal direction of said mother tube at a median point of said die cavity, said first die half being movable in the longitudinal direction toward and away from the second die half;

a plug member adapted to be inserted into said mother tube and movable in the longitudinal direction thereof, forming a clearance of a predetermined width around the inner periphery of said die bearing portions;

a carriage drive mechanism to move said carriage in a first direction until said inner stepped wall portion of the gripped mother tube aligns with said die cavity and to rest said carriage at such position for a predetermined time length before advancing said carriage again in said first direction;

a plug drive mechanism to position and hold said plug member fixedly in a bearing portion on a side of said carriage during movement of said carraige in said first direction, to advance said plug member up to the other bearing portion during resting of said carriage, and to hold the plug member fixedly at that position during said advancing of said carriage; and releasable fixing means to hold said first and second die halves in a joined state during movement of said carriage as well as during the movement of said plug member and to release said first and second die halves from the joined state prior to said advancing of said carriage.

3. The apparatus as set forth in claim 2, further comprising a guide rail for guiding said movement and advancing of said carriage in the longitudinal direction of said mother tube.

4. The apparatus as set forth in claim 2, further comprising a plurality of guide rolls provided at suitable intervals in the longitudinal direction of said mother tube and means for shifting said guide rolls between upper and lower positions for supporting said mother tube and said plug member in a horizontal state.

5. The apparatus as set forth in claim 2, wherein said plug drive mechanism further comprises a hydraulic piston-cylinder and means for detachably fixing said plug member at the fore end of the piston rod of said hydraulic cylinder.

6. The apparatus as set forth in claim 2, wherein said carriage further comprises a chuck member positioned on the front side thereof for gripping said mouth portion of said mother tube.

* * * * *